US009086196B2

(12) United States Patent
Monteilliet et al.

(10) Patent No.: US 9,086,196 B2
(45) Date of Patent: Jul. 21, 2015

(54) AIRLOCK COMPRISING A LIGHTING DEVICE

(75) Inventors: Gilles Monteilliet, Issy-les-Moulineaux (FR); Florence Guillemot, Issy-les-Moulineaux (FR); Francois Rieul, Issy-les-Moulineaux (FR)

(73) Assignee: MORPHO, Issy-Les Moulineaux (FR)

( * ) Notice: Subject to any disclaimer, the term of this patent is extended or adjusted under 35 U.S.C. 154(b) by 0 days.

(21) Appl. No.: 13/991,195

(22) PCT Filed: Nov. 28, 2011

(86) PCT No.: PCT/EP2011/071214

§ 371 (c)(1),
(2), (4) Date: Aug. 13, 2013

(87) PCT Pub. No.: WO2012/072598

PCT Pub. Date: Jun. 7, 2012

(65) Prior Publication Data

US 2013/0314908 A1 Nov. 28, 2013

(30) Foreign Application Priority Data

Dec. 3, 2010 (FR) ..... 10 60063

(51) Int. Cl.

| | |
|---|---|
| ***F21S 8/00*** | (2006.01) |
| ***E05G 5/00*** | (2006.01) |
| ***F21V 33/00*** | (2006.01) |
| ***G07C 9/00*** | (2006.01) |
| ***E06B 11/02*** | (2006.01) |
| ***F21V 5/02*** | (2006.01) |

(52) U.S. Cl.

CPC . *F21S 8/00* (2013.01); *E05G 5/003* (2013.01); *E06B 11/02* (2013.01); *F21V 5/02* (2013.01); *F21V 33/006* (2013.01); *G07C 9/00158* (2013.01)

(58) Field of Classification Search

CPC ..... F21S 8/024; F21S 8/033
USPC ..... 362/152, 147
See application file for complete search history.

(56) References Cited

U.S. PATENT DOCUMENTS

| | | | | |
|---|---|---|---|---|
| 2004/0031234 | A1 | 2/2004 | Emde | |
| 2004/0135072 | A1 | 7/2004 | Huff | |
| 2007/0176777 | A1 * | 8/2007 | Reime | 340/545.3 |
| 2007/0271846 | A1 | 11/2007 | Miller et al. | |
| 2012/0163027 | A1 * | 6/2012 | Vissenberg et al. | 362/612 |
| 2014/0022813 | A1 * | 1/2014 | Krijn et al. | 362/606 |

FOREIGN PATENT DOCUMENTS

| | | | |
|---|---|---|---|
| EP | 1496186 | A1 | 1/2005 |

* cited by examiner

*Primary Examiner* — Sean Gramling
(74) *Attorney, Agent, or Firm* — Bachman & LaPointe, P.C.

(57) ABSTRACT

A security gate has two walls defining between them a passage through which an individual passes, for each wall, a transparent lighting window extending over at least part of the wall, for at least one of the edges of the lighting window, a light source intended to light the edge and to generate light beams that propagate through the thickness of the lighting window, and for each lighting window, at least one extraction zone provided on the lighting window and intended to transmit the light beams towards the face of the individual passing through the passage, the light beams thus transmitted forming, with respect to the plane of the lighting window from which they emanate, an angle adapted to the geometry of the security gate so as to optimize the lighting of the individual.

10 Claims, 2 Drawing Sheets

AIRLOCK COMPRISING A LIGHTING DEVICE

BACKGROUND

The present invention concerns a security gate having a lighting device. The invention applies in the security field for protecting access to a particular place.

In order to check the identity of an individual entering a place, a security gate is provided at the entry to this place. Such a security gate comprises a small room with an entrance and exit and a facial recognition device provided for capturing the image of the face of the individual and comparing it with a list of suspect individuals.

In order to acquire an image of the face in a security gate in an optimum fashion, it is necessary to position two light sources. The light sources are positioned at approximately 45° in front of the face at the time of capture thereof. In addition, the lighting sources have large surfaces in order to prevent reflections and hotspots. Such lighting sources therefore have a large space requirement.

However, a security gate must remain of modest size, which is not compatible with current light source technologies Furthermore, in order not to obscure the inside of the security gate, the walls that delimit it must be transparent and thus enable security teams to monitor the behaviour of individuals in the security gate.

SUMMARY OF THE INVENTION

One object of the present invention is to propose a security gate comprising an improved lighting device and which does not have the drawbacks of the prior art.

To this end, a security gate is proposed comprising:

- two walls defining between them a passage in which an individual passes,
- for each wall, a transparent lighting window extending over at least part of said wall,
- for at least one of the edges of the lighting window, a light source intended to illuminate said edge and to generate light beams propagating in the thickness of the lighting window,
- for each lighting window, at least one extraction zone produced on said lighting window and intended to transmit said light beams towards the face of the individual passing through said passage, the light beams thus transmitted forming, with respect to the plane of the lighting window from which they issue, an angle suited to the geometry of said security gate so as to optimise the illumination of the individual.

Advantageously, the light beams thus transmitted form an angle of between 30° and 60°.

Advantageously, the light beams thus transmitted form an angle of approximately 45°.

According to a particular embodiment, each extraction zone comprises a first zone disposed on the external face of the lighting window and a second zone disposed on the internal face of the lighting window, the first zone comprising means for modifying the rules of reflection of the light beams on said external face so that they are reflected towards said internal face and transmitted through it, and the second zone comprises means for orienting the light beams transmitted towards the face of the individual.

Advantageously, the beams of the first zone consist of a patch of diffusing paint.

Advantageously, the means of the second zone consist of prisms.

Advantageously, the prisms are pressed against the lighting window by means of their vertices.

According to another particular embodiment, each extraction zone comprises prisms disposed on the internal face of the lighting window by means of their bases.

Advantageously, the prisms are fixed to the internal face of the lighting window by means of an optical coupling means.

Advantageously, the security gate has a single light source, it has at least two extraction zones disposed at different distances from said light source, and the surface of each extraction zone is such that the light power received by the face of the individual from each extraction zone is substantially the same.

Advantageously, the edge of the lighting window that is opposite to the edge illuminated by said light source carries a supplementary transmission device disposed along said opposite edge and intended to transmit the light beams towards the face of the individual.

BRIEF DESCRIPTION OF THE DRAWINGS

The features of the invention mentioned above, as well as others, will emerge more clearly from a reading of the following description of an example embodiment, said description being given in relation to the accompanying drawings, among which.

DETAILED DESCRIPTION

Figure 1:
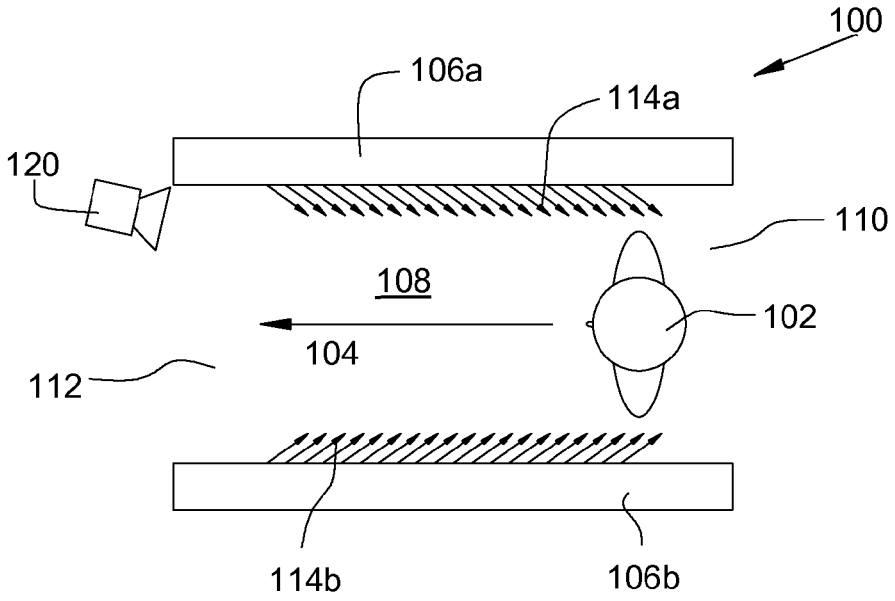
FIG. 1 is a schematic representation of a security gate according to the invention in plan view.

FIG. 1 shows a security gate 100 through which an individual 102 is passing, moving in the direction of the arrow 104, which represents the direction of progress of the individual 102 in the security gate 100.

The security gate 100 comprises two walls 106*a* and 106*b* that delimit between them a passage 108 through which the individual 102 passes. The security gate 100 comprises an entrance 110 through which the individual 102 enters the passage 108 and an exit 112 through which he leaves it.

In the vicinity of the exit 112 there is disposed a capture device 120 that is intended to take an image of the face of the individual 102. The capture device 120 forms part of a more complete facial recognition system that also makes it possible to compare the image of the face thus captured with face images recorded in a database.

Each wall 106*a*, 106*b* has a lighting device that is described below and generates light beams respectively referenced 114*a* and 114*b* that are oriented so as to illuminate the face of the individual 102 during his progress through the security gate 100, and this in an optimum manner so that the image captured by the capture device 120 is as usable as possible.

In the figs., the arrows 114*a* and 114*b* represent the principal direction of illumination, which corresponds to the principal direction of the light lobe resulting from the transmission. Each light lobe thus has an illumination zone located towards the face of the individual 102 and, as the individual 102 progresses, each light lobe successively switches off, thus ensuring appropriate illumination throughout the passage 108.

Figure 2:
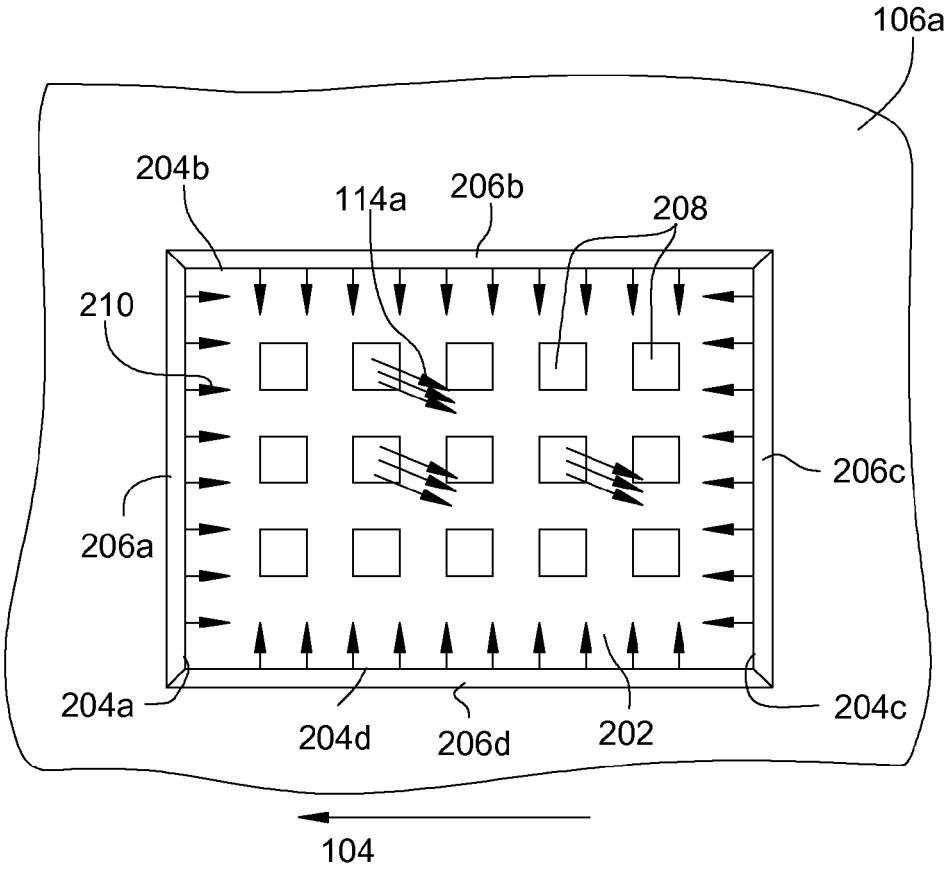
FIG. 2 is a side view of a wall of the security gate of FIG. 1 according to a particular embodiment of the invention.

FIG. 2 shows a particular embodiment of the wall 106*a* but the other wall 106*b* has the same features.

The wall 106*a* has a lighting window 202 that extends over part of the wall 106*a* and is disposed so as to illuminate the faces of the individuals 102 passing through the security gate 100 at the time of capture of the faces.

The lighting windows 202 of the two walls 106*a* and 106*b* are facing each other in order to ensure uniformity of the illumination of the two sides of the face of the individual 102.

Each lighting window 202 consists of a transparent material of the glass, PMMA (polymethyl methacrylate) etc type, which enables the security teams placed outside the security gate 100 to monitor the behaviour of the individual 102 in the security gate 100. In this case, monitoring is facilitated if the rest of the wall 106*a* is also transparent.

Naturally, it is possible to provide for the lighting window 202 to cover the wall 106*a* entirely. In this case, it is the entire wall 106*a*, 106*b* that is transparent.

In order words, the lighting window 202 extends over at least part of the wall 106*a* and is coplanar with it.

The lighting window 202 is delimited here by four rims 204*a-d*.

To each rim 204*a-d* there corresponds an edge of the lighting window 202 that extends in the thickness of the lighting window 202.

Along at least one of the edges (here the four corresponding to the four rims 204*a-d*) there is disposed a light source 206*a-d* that illuminates the edge in question towards the inside of the lighting window 202.

Each light source 206*a-d* takes for example the form of a fluorescent tube or an array of light emitting diodes (LEDs).

Each light beam 210 thus generated propagates in the thickness of the lighting window 202, which constitutes a light guide for the light beams 210.

The light sources 206*a-d* are chosen so that the angles of the light beams that they emit are such that said light beams 210 can be reflected inside the lighting window 202 without their being able to be transmitted towards the outside of the lighting window 202 in an inappropriate manner.

So that the light beams 210 are transmitted appropriately, that is to say so that they illuminate the face of the individual 102 with an appropriate angle for obtaining the best possible illumination, the lighting window 202 has at least one extraction zone 208, each being intended to enable some of the light beams 114*a*, 114*b* of the lighting window 202 to exit at said angle.

Optimally, the exit angle of the light beams transmitted 114*a*, 114*b* is around 45° with respect to the plane of the lighting window 202 from which they issue and oriented towards the entrance 110.

However, the exit angle of the light beams transmitted 114*a*, 114*b* may be different according to the geometry of the security gate 100. This is because the width and length of the security gate 100 may vary from one security gate 100 to another, and the exit angle of the light beams transmitted 114*a* and 114*b* must be adapted according to this geometry so as to optimise the illumination of the individual.

The exit angle of the light beams transmitted 114*a*, 114*b* is then preferably between 30° and 60°.

Figure 3:
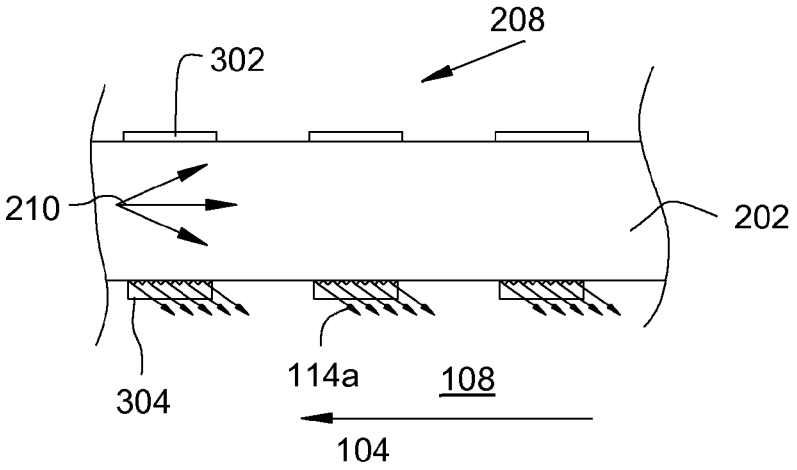
FIG. 3 depicts an edge of the wall of FIG. 2 in plan view according to a first embodiment of the invention.

FIG. 3 presents a particular embodiment of the extraction zones 208. Each extraction zone 208 comprises a first zone 302 and a second zone 304 that is disposed on the internal face of the lighting window 202 that is oriented towards the passage 108, that is to say towards the inside of the security gate 100. The first zone 302 is disposed on the other face of the lighting window 202, that is to say the one that is oriented towards the outside of the security gate 100 and constitutes the external face of the lighting window 202.

The first zone 302 comprises means for modifying the rules of reflection of the light beams 210 inside the lighting window 202 on the external face so that they are reflected towards the internal face and transmitted through it. The second zone 304 comprises means for orientating the transmitted beams 114*a* appropriately, that is to say towards the face of the individual 102.

To each first zone 302 there corresponds a second zone 304 and they are disposed facing each other on either side of the lighting window 202.

The first zone 302 can take for example the form of a patch of diffusing paint.

The second zone 304 can take for example the form of prisms, such as for example a polyester or polycarbonate film supporting a grooved surface structure in the form of microprisms with a symmetrical or asymmetric profile. The height of the symmetrical microprisms is for example around 100 μm. The angle of the prisms is chosen so as to obtain the required angle for the transmitted beams 114*a*.

In the embodiment in FIG. 3, the prisms are pressed up against the lighting window 202 by means of their vertices.

Figure 4:
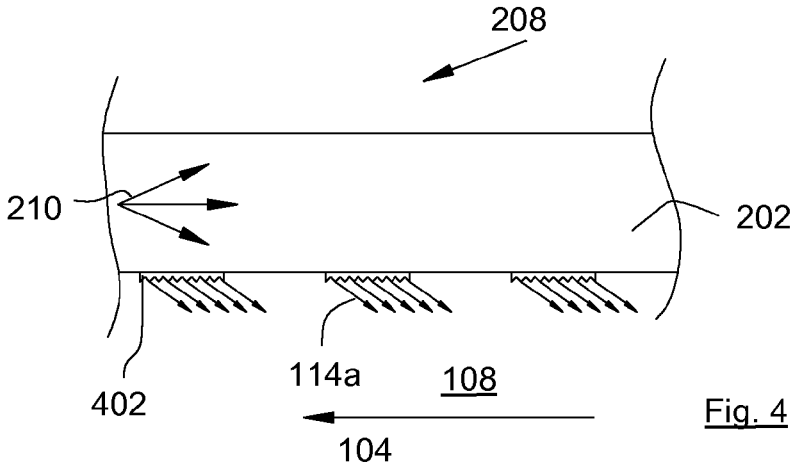
FIG. 4 is a view similar to FIG. 3 according to a second embodiment of the invention.

FIG. 4 presents another particular embodiment of the extraction zones 208. Each extraction zone 208 has the form of a patch 402 that is optically coupled to the internal face of the lighting window 202.

The patch 402 is intended to orient the transmitted beams 114*a* in an appropriate manner. The patch 402 comprises for example prisms, such as for example a polyester or polycarbonate film supporting a grooved surface structure in the form of microprisms with a symmetrical or asymmetric profile. The height of the symmetrical microprisms is for example around 100 μm. The angle of the prisms is chosen so as to obtain the required angle for the transmitted beams 114*a*.

In the embodiment in FIG. 4, the prisms are pressed up against the lighting window 202 by means of their bases.

Each patch 402 is fixed to the lighting window 202 by means of an optical coupling means such as for example index liquid or a transparent optical adhesive that improves the coupling between the two and allows transmission of the light beams 210 towards the outside of the lighting window 202.

Naturally, it is possible to provide other means to enable light beams 114*a* and 114*b* to be extracted. In particular, it is possible to etch prisms in the lighting window 202.

The number and distribution of the patches 302, 304 and 402 depend on many parameters, such as for example the material constituting the lighting window 202, the light power delivered by the light sources 206*a-d*, etc.

According to a particular embodiment of the invention, each patch 302, 304, 402 is a square with sides of 3 cm, and they are spaced apart at approximately 3 cm from one another.

In the embodiment in FIG. 3, the surface of the patches 304 may represent between 30% and 80% of the total surface of the lighting window 202 and preferentially approximately 70%.

The patches 304 and 402 are produced from polyester or polycarbonate films with etchings of prisms 50 to 200 microns high and with a recurrence step of the pattern.

The angle of the prisms is chosen in the principal direction (45°) required for extraction of the light beams 114*a* and 114*b*.

The invention avoids having protrusions on the lighting windows 202 of the security gate 100, the light beams transmitted 114*a* and 114*b* are directed optimally and in a way that is easily adaptable for change of prisms.

The distribution of the patches also makes it possible to adjust the illumination at the zone capturing the images of the faces.

Figure 5:
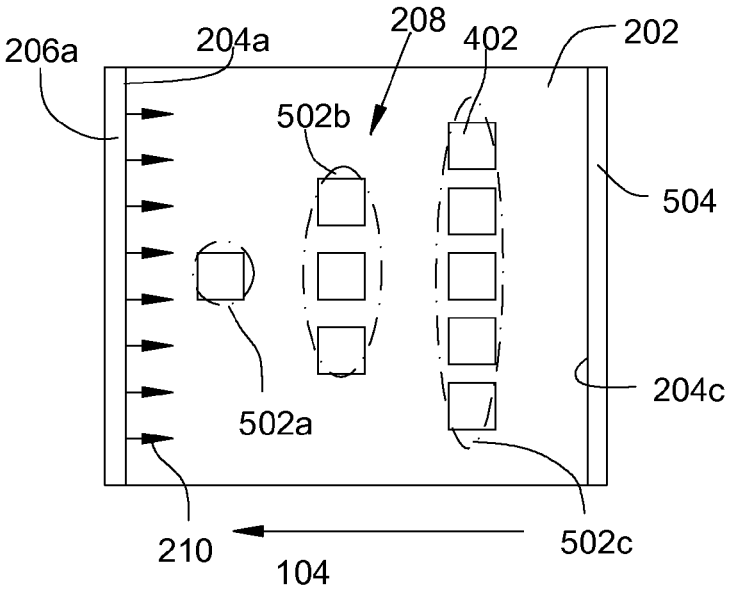
FIG. 5 is a view similar to FIG. 2 according to a particular embodiment of the invention.

FIG. 5 shows a particular distribution mode of the invention using patches 402 of FIG. 4.

The lighting window 202 is illuminated along only one of its sides (204*a*) by means of a single light source 206*a*. Here it is the side 204*a* that is disposed on the same side as the exit 102, that is to say upstream with respect to the direction of advance of the individual 102.

The embodiment in FIG. 5 presents three extraction zones 502*a-c*, that is to say at least two.

The extraction zones 502*a-c* are disposed at different distances from the light source 206*a*.

Each extraction zone 502*a-c* consists of one or more patches 402 that are distributed so as to obtain a distribution of the light that is practically uniform along the passage 108.

The first extraction zone 502*a* is the closest to the light source 206*a* and has the smaller surface and comprises here a single patch 402.

The second extraction zone 502*b* is a little further away from the light source 206*a* and consists here of three patches 402 that represent a total surface greater than that of a single patch 402. As the second extraction zone 502*b* is further away from the light source 206*a* than the first extraction zone 502*a*, it transmits a lower light power for the same surface, and this is why the establishment of a second extraction zone 502*b* having a larger surface compensates for this lack.

The same functioning for the third extraction zone 502*c* means that the total surface of the third extraction zone 502*c* is greater than the total surface of the second extraction zone 502*b*. In the embodiment of the invention shown here, the third extraction zone 502*c* has five patches 402.

The surface of each extraction zone 502*a-c* is thus such that the light power received by the face of the individual 102 from each extraction zone 502*a-c* is substantially the same.

Naturally, the dimensions and positions of the patches 402 of each extraction zone 502*a-c* and the number of extraction zones 502*a-c* may be different as long as the illumination light power created by each extraction zone 502*a-c* is substantially the same for the individual passing through the security gate 100.

Each extraction zone 502*a-c* is located substantially vertically on the illumination window 202.

A supplementary transmission device 504 is disposed along the edge that is opposite to the edge illuminated by said light source 206*a*, that is to say here along the side 204*c* that extends parallel to the side 204*a*. The supplementary transmission device 504 is intended to transmit light beams 210 that travel in the lighting window 202 towards the outside and thus affords supplementary lighting on the face of the individual 102.

The supplementary transmission device 504 takes for example the form of a prism stuck on the edge of the lighting window 202 by means of an optical adhesive.

Naturally, the present invention is not limited to the examples and embodiments described and depicted but is capable of numerous variants accessible to persons skilled in the art.

The invention claimed is:

1. A security gate comprising:

two walls defining between them a passage in which an individual passes, for each said wall, a transparent lighting window extending over at least part of said wall, for at least one of the edge of each transparent lighting window, a light source intended to illuminate said at least one edge and to generate light beams propagating in a thickness of the lighting window, and for each lighting window, at least one extraction zone produced on said lighting window, and intended to transmit said light beams towards a face of an individual passing through said passage, wherein the light beams thus transmitted forming, with respect to a plane of the lighting window from which the light beams issue, an angle suited to a geometry of said security gate so as to optimize illumination of the individual, wherein the light beams are oriented towards an entrance of the passage and wherein said angle is between 30 degrees and 60 degrees with respect to the plane of the lighting window.

2. The security gate according to claim 1, wherein the light beams thus transmitted form an angle of approximately 45°.

3. The security gate according to claim 1, wherein each said a extraction zone comprises a first zone disposed on an external face of the lighting window and a second zone disposed on an internal face of the lighting window, the first zone comprises means for modifying rules of reflection of the light beams on said external face so that the light beams are reflected towards said internal face and transmitted through said internal face, and the second zone comprises means for orienting the transmitted light beams towards the face of the individual.

4. The security gate according to claim 3, wherein the modifying means of the first zone consist of a patch of diffusing paint.

5. The security gate according to claim 3, wherein the orienting means of the second zone consist of prisms.

6. The security gate according to claim 5, wherein each of the prisms a vertex and the prisms are pressed against the lighting window by means of said vertices.

7. The security gate according to claim 1, wherein each said extraction zone comprises prisms disposed on an internal face of the lighting window by means of their bases of the prisms.

8. The security gate according to claim 7, wherein the prisms are fixed to the internal face of the lighting window by means of an optical coupling means.

9. The security gate according to claim 1, wherein said security gate comprises a single light source, at least two extraction zones disposed at different distances from said light source, and a surface of each said extraction zone is such that light power received by the face of the individual from each said extraction zone is substantially the same.

10. The security gate according to claim 9, wherein an edge of the lighting window that is opposite to an edge illuminated by said light source carries a supplementary transmission device disposed along said opposite edge and intended to transmit the light beams towards the face of the individual.

* * * * *